US007816614B2

(12) United States Patent
Li

(10) Patent No.: US 7,816,614 B2
(45) Date of Patent: Oct. 19, 2010

(54) SWITCH USING ELASTIC SHEET

(75) Inventor: Hua-Ping Li, ShenZhen (CN)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 391 days.

(21) Appl. No.: 11/784,838

(22) Filed: Apr. 10, 2007

(65) Prior Publication Data

US 2007/0235310 A1 Oct. 11, 2007

(30) Foreign Application Priority Data

Apr. 10, 2006 (TW) ..... 95205943 U

(51) Int. Cl.
*H01H 1/10* (2006.01)

(52) U.S. Cl. ..... 200/516; 200/512

(58) Field of Classification Search ..... 200/512–517
See application file for complete search history.

(56) References Cited

U.S. PATENT DOCUMENTS

| | | | | | |
|---|---|---|---|---|---|
| 5,834,715 | A * | 11/1998 | Sato et al. | ..... | 200/5 A |
| 5,842,561 | A * | 12/1998 | Takahashi | ..... | 200/406 |
| 6,917,007 | B2 | 7/2005 | Hirai et al. | | |
| 7,310,088 | B2 * | 12/2007 | Senzui et al. | ..... | 345/173 |
| 2007/0039812 | A1 * | 2/2007 | Sjostrom | ..... | 200/512 |

* cited by examiner

*Primary Examiner*—Kyung Lee
(74) *Attorney, Agent, or Firm*—Wei Te Chung

(57) ABSTRACT

A sheet switch includes an elastic sheet (4) and a circuit board (5). The elastic sheet has a first sheet (10) having a metal sheet (11) plated on an upper surface thereof, a bending portion (12) bent toward the circuit board from a lateral extension thereof and a tail portion (121) extending backwardly from the bending portion for connecting with the circuit board. The elastic sheet further has a plurality of moveable contacts (20) attached to a lower surface of the first sheet, wherein the bending portion of the first sheet having a conductive component (14) affixed thereon.

14 Claims, 4 Drawing Sheets

SWITCH USING ELASTIC SHEET

BACKGROUND OF THE INVENTION

1. Field of the invention

The present invention relates to an elastic sheet used in a switch, and particularly to a sheet switch applied in mobile phone or the likes.

2. Description of Related Art

A conventional sheet switch using an elastic sheet 4' is disclosed in FIGS. 1-2. The elastic sheet 4' for connecting with a circuit board 5' comprises a first sheet 10' having a metal sheet 11' thereon, a plurality of moveable contacts 20' attached to a bottom surface of the first sheet 10' and a separate sheet 30'. The separate sheet 30' is affixed to a lower surface of the first sheet 10' by adhesive 32' smeared on an upper surface thereof. The first sheet 10' has a bending portion 12' bending toward the circuit board 5' along the line II-II for contacting a ground end 53' formed on an upper surface of the circuit board 5'.

The elastic sheet switch comprises the elastic sheet 4' and the circuit board 5'. Before assembling of the elastic sheet 4' and the circuit board 5', the separate sheet 30' is peeled off from the bottom surface of the first sheet 10'. The bending portion 12' of elastic sheet 4' is attached to the ground end 53' for discharging electrostatic charges accumulated on the first sheet 10'. The circuit board 5' has a plurality of fixed contacts 50' each having a central fixed contact 52' and an outer fixed contact 51' encircling around, but insulated from, the central fixed contact 52'. A fringe portion of each moveable contact 20' abuts against the outer fixed contact 51'. A center portion 21' of the moveable contact 20' is separated from the central fixed contact 52'. The center portion 21' is capable of being depressed downwardly for contacting with the central fixed contact 52'. The outer fixed contact 51' and the center fixed contact 52' are therefore electrically connected via the moveable 20'.

However, when the bending portion 12' is connected to the ground end 53', the bending portion 12' is apt to damage by electrostatic discharge.

Hence, an improved sheet switch is desired to overcome the disadvantages of the prior art.

BRIEF SUMMARY OF THE INVENTION

An object of the present invention is to provide a sheet switch using an elastic sheet which may withstand electrostatic discharge.

The sheet switch comprises an elastic sheet and a circuit board. The elastic sheet has a first sheet having a metal sheet plated on an upper surface thereof, a bending portion bent toward the circuit board from a lateral extension thereof and a tail portion extending backwardly from the bending portion for connecting with the circuit board. The bending portion of the first sheet has a conductive component affixed on an outer surface thereon. The elastic sheet further includes a plurality of moveable contacts attached to a lower surface of the first sheet. The circuit board has a plurality of fixed contacts. Each fixed contact includes a central fixed contact and an outer fixed portion for engaging with the moveable contacts.

The elastic sheet has a conductive component affixed on the bending portion of the first sheet thereof. The conductive component could prevent the first sheet from being damaged by the electrostatic discharge.

Other objects, advantages and novel features of the invention will become more apparent from the following detailed description of a preferred embodiment when taken in conjunction with the accompanying drawings.

DETAILED DESCRIPTION OF THE INVENTIONS

Figure 1:
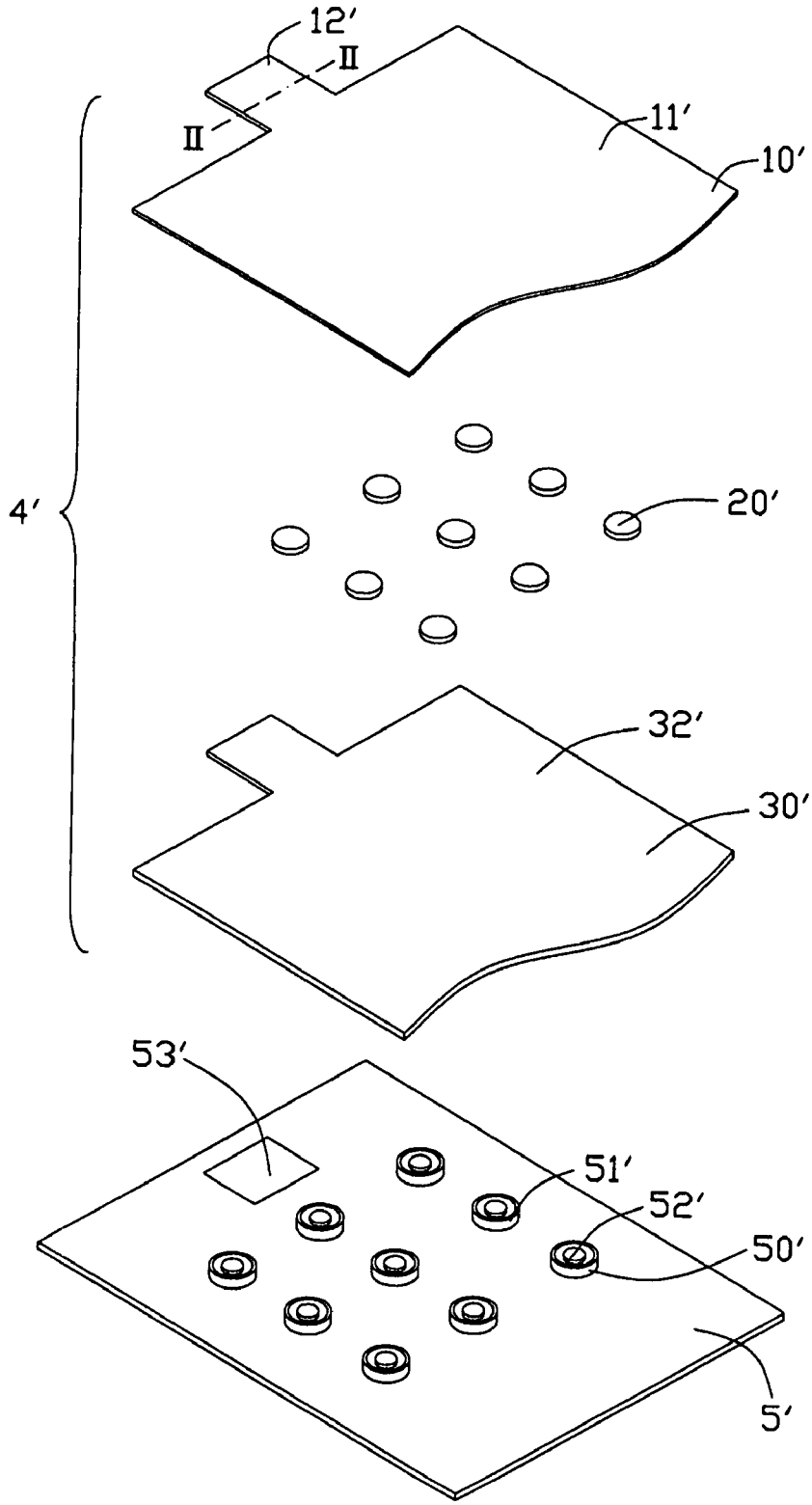
FIG. 1 (PRIOR ART)
FIG. 1 is an exploded view of a conventional sheet switch.
Figure 2:
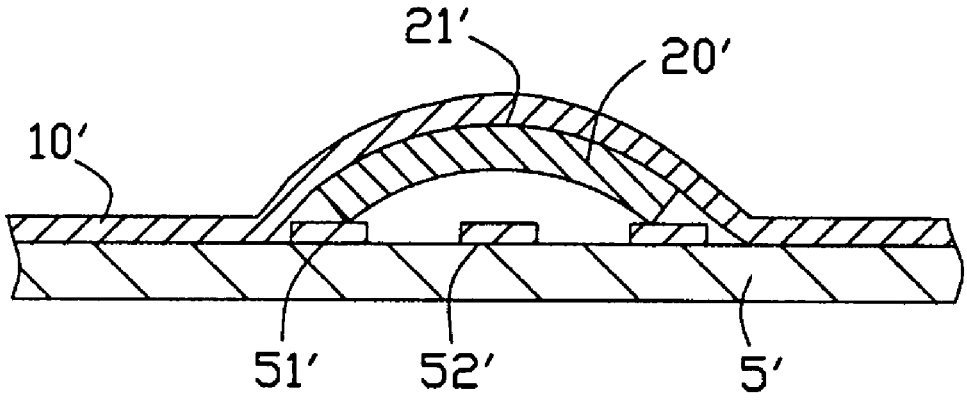
FIG. 2 (PRIOR ART)
FIG. 2 is a cross-sectional view of a portion of the sheet switch as shown in FIG. 1.
Figure 3:
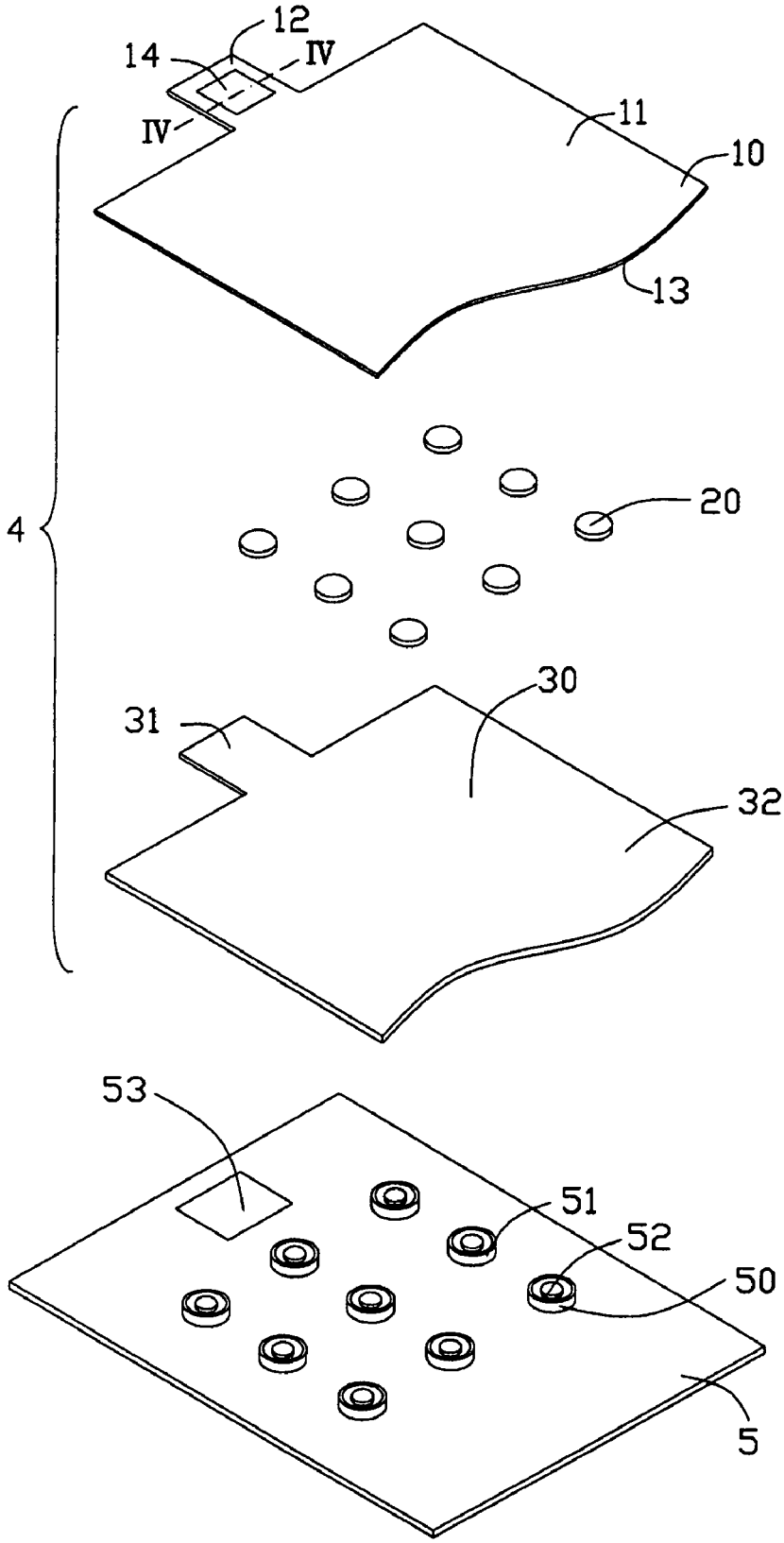
FIG. 3 is an exploded view of the sheet switch in accordance with the present invention.

Referring to FIG. 3, a sheet switch in accordance with a preferred embodiment of the present invention comprises an elastic sheet 4 and a circuit board 5. The elastic sheet 4 has a first sheet 10, a plurality of moveable contacts 20 and a separate sheet 30.

Figure 4:
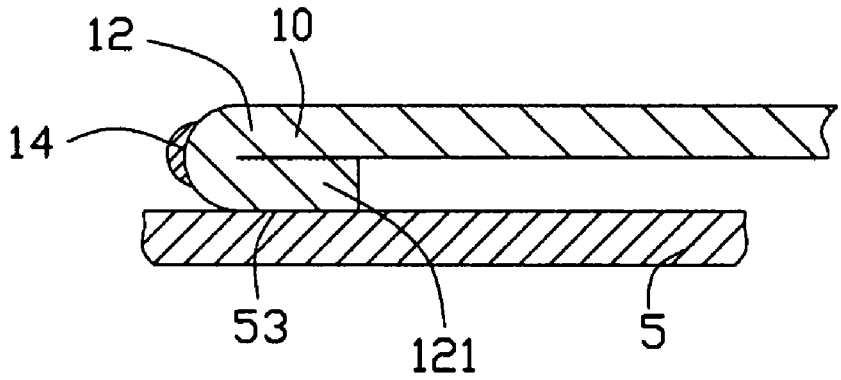
FIG. 4 is a partially cross-sectional view of a bending portion bent along line IV-IV of a first sheet for connecting with a circuit board shown in FIG. 3.

The first sheet 10 is made of insulative material and has a metal sheet 11 affixed on an upper surface thereof. The first sheet 10 comprises a bending portion 12 bending toward the circuit board 5 from a lateral extension thereof and a tail portion 121 extending backwardly from the bending portion 12, as shown in FIG. 4. A metal sheet is affixed throughout an upper surface of the bending portion 12. A reticulated metal sheet is affixed on an upper surface of other portions of the first sheet 10. The first sheet 10 has adhesive 13 smeared on a lower surface thereof. The bending portion 12 bends toward the circuit board 5 along the line IV-IV and has a conductive component 14 attached on an outer surface thereof. In another embodiment, the conductive component 14 could be attached on the outer and inner surfaces of the bending portion 12.

Each moveable contact 20 comprises a central portion 21 and an outer portion 201.

The separate sheet 30 has a second lateral extension 31 extending from a lateral extension thereof and has adhesive 32 smeared on an upper surface thereof. The separate sheet 30 is conglutinated to the lower surface of first sheet 10 by adhesive 32, for preventing dust or the likes from being affixed to the lower surface.

The circuit board 5 comprises a plurality of fixed contacts 50 each having an outer fixed contact 51 and a central fixed contact 52 for engaging with the movable contacts 20. The circuit board 5 further comprises a ground end 53 formed on a lateral extension thereof for contacting the tail portion 121 of first sheet 10.

Figure 5:
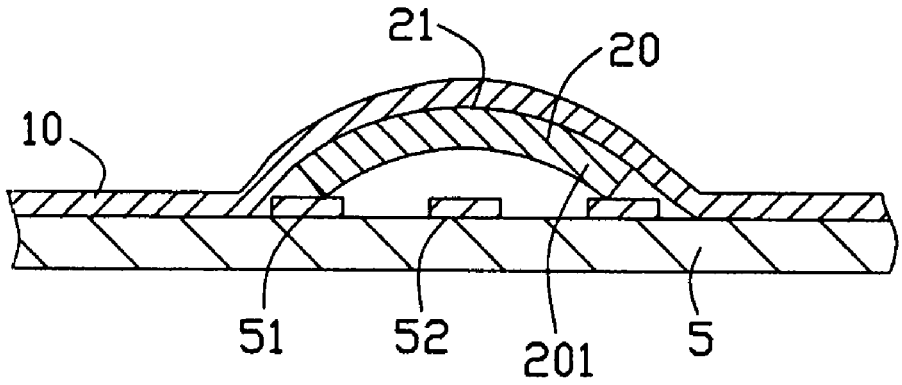
FIG. 5 is a partially cross-sectional view of the sheet switch.

Referring to FIGS. 3-5, when the elastic sheet 4 is assembled to the circuit board 5, the separate sheet 30 is peeled off from the elastic sheet 4 and the central portion 21 is affixed on the lower surface of the first sheet 10 by adhesive 13. The first sheet 10 together with the movable contacts 20 is affixed onto the circuit board 5 via adhesive 13. The lower end of outer portion 201 of movable contact 20 abuts against the outer fixed contact 51. The central portion 21 of the movable contact 20 is separated from the central fixed contact 52. Referring to FIG. 4, the bending portion 12 comes to contact with the ground end 53 of the circuit board 5 for discharging electrostatic charges accumulated on the elastic sheet 4. During such a process, the conductive component 14 can prevent the bending portion 12 of the first sheet 10 from being damaged by the electrostatic discharge.

The operation of the sheet switch will now be described. When an operating force is exerted on the central portion 21 of the moveable contact 20, the central portion 21 is depressed downwardly for coming into contact with the central fixed contact 52. The central fixed contact 52 is electrically connected with the outer fixed contact 51 via the moveable contact 20. Upon releasing of the operation force, the central portion 21 of the movable contact 20 moves away from the central fixed contact 52 due to an elastic restoring force of the movable contact 20. The fixed contact 52 is thereby electrically disconnected from the outer fixed contact 51.

It will be understood that the invention may be embodied in other specific forms without departing from the spirit or central characteristics thereof. The present examples and embodiments, therefore, are to be considered in all respects as illustrative and not restrictive, and the invention is not to be limited to the details given herein.

What is claimed is:

1. An elastic sheet for connecting with a circuit board having a grounding pad and a plurality of fixed contacts formed thereon, comprising:

a first sheet having a metal sheet plated on an upper surface thereof, a bending portion bent toward the circuit board from a lateral extension thereof and a tail portion extending backwardly from the bending portion for connecting with the grounding pad of the circuit board;

a plurality of moveable contacts attached to a lower surface of the first sheet aligned with the corresponding fixed contacts, respectively;

wherein the bending portion of the first sheet having a conductive component affixed thereon.

2. The elastic sheet as claimed in claim 1, wherein said conductive component is disposed on an outer surface of the bending portion of the first sheet.

3. The elastic sheet as claimed in claim 2, further comprising a conductive component, wherein said conductive is disposed on an inner surface of the bending portion of the first sheet.

4. The elastic sheet as claimed in claim 1, wherein said first sheet has a metal sheet affixed on outer surface of the bending portion thereof, and a reticulated metal sheet affixed on the outer surface of other portions of first sheet.

5. The elastic sheet as claimed in claim 1, further comprising a separate sheet affixed on a lower surface of the first sheet before the first sheet is assembled to the circuit board.

6. The elastic sheet as claimed in claim 5, wherein said separate sheet comprises a second lateral extension affixing to the lateral extension of the first sheet.

7. A sheet switch comprising the elastic sheet as claimed in claim 1 and a circuit board, wherein said circuit board comprises a plurality of fixed contacts for engaging with the moveable contacts.

8. The sheet switch as claimed in claim 7, wherein each fixed contact comprises a central fixed contact and an outer fixed contact, and wherein said moveable contact has a central portion disposed above the central fixed contact and an outer portion in contact with the outer fixed contact.

9. The sheet switch as claimed in claim 8, wherein when the movable contact is depressed, the central portion of the moveable contact comes to contact with the central fixed contact, thereby electrically connecting the central fixed contact with the outer fixed contact.

10. A sheet switch assembly comprising:

a printed circuit board having fixed contacts and a grounding pad thereon;

an elastic sheet having moveable contacts on an undersurface thereof attached to the printed circuit board so as to have the moveable contacts aligned with the corresponding fixed contacts, respectively; and a folded portion unitarily formed on one edge of the elastic sheet and disposed upon the grounding pad; wherein a conductive mass applied to a bending edge of said folded portion.

11. The sheet switch assembly as claimed in claim 10, wherein said conductive mass is applied to an upper surface of the folded portion when said folded portion is in an unfolded manner.

12. The sheet switch assembly as claimed in claim 10, wherein said folded portion is a protrusion beyond said edge.

13. A sheet switch assembly comprising:

a printed circuit board having fixed contacts and a grounding pad thereon;

an elastic sheet having movable contacts on an undersurface thereof attached to the printed circuit board so as to have the moveable contacts aligned with the corresponding fixed contacts, respectively; and a folded portion unitarily formed on one edge of the elastic sheet and disposed upon the grounding pad; wherein said conductive mass is applied to an upper surface of the folded portion when said folded portion is in an unfolded manner under condition that half of said conductive mass contacts the grounding pads when said folded portion is in a folded manner.

14. The sheet switch assembly as claimed in claim 13, wherein said folded portion protrudes beyond said edge.

* * * * *